United States Patent [19]

Nakase

[11] Patent Number: 4,565,528

[45] Date of Patent: Jan. 21, 1986

[54] TILTING MECHANISM FOR MARINE PROPULSION DEVICE

[75] Inventor: Ryoichi Nakase, Hamamatsu, Japan

[73] Assignee: Sanshin Kogyo Kabushiki Kaisha, Hamamatsu, Japan

[21] Appl. No.: 590,891

[22] Filed: Mar. 16, 1984

[30] Foreign Application Priority Data

Mar. 19, 1983 [JP] Japan ..... 58-45322

[51] Int. Cl.[4] ..... B63H 71/76

[52] U.S. Cl. ..... 440/1; 440/61

[58] Field of Search ..... 440/1, 49, 53, 55, 56, 440/61-66; 114/277; 940/900

[56] References Cited

U.S. PATENT DOCUMENTS

| | | | |
|---|---|---|---|
| 3,039,724 | 6/1962 | Herreman | 440/61 |
| 3,434,449 | 3/1969 | North | 440/61 |
| 3,460,505 | 8/1969 | Thoene | 440/55 |
| 3,468,282 | 9/1969 | Wintercorn | 440/61 |
| 3,834,345 | 9/1974 | Hager et al. | 440/61 |
| 3,839,986 | 10/1984 | Meyer et al. | 440/61 |
| 4,318,699 | 3/1982 | Wenstadt et al. | 440/61 |
| 4,395,239 | 7/1983 | Hall et al. | 440/61 |

*Primary Examiner*—Trygve M. Blix
*Assistant Examiner*—Stephen P. Avila
*Attorney, Agent, or Firm*—Ernest A. Beutler

[57] ABSTRACT

Several embodiments of trim and tilt arrangements for outboard drives that adjust the trim condition of the outboard drive unit in response to driving thrust and/or velocity of the boat so as to provide the optimum flow resistance under all conditions.

22 Claims, 10 Drawing Figures

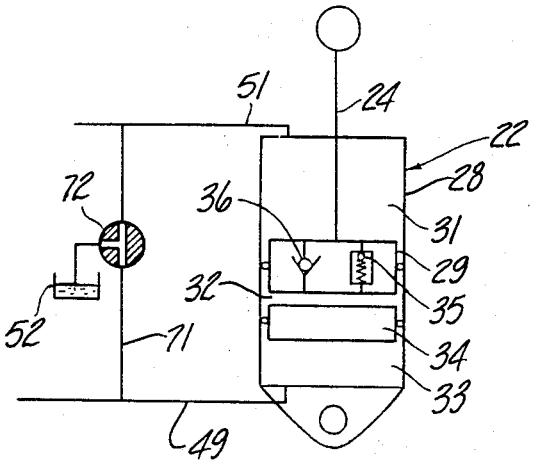
Fig-6
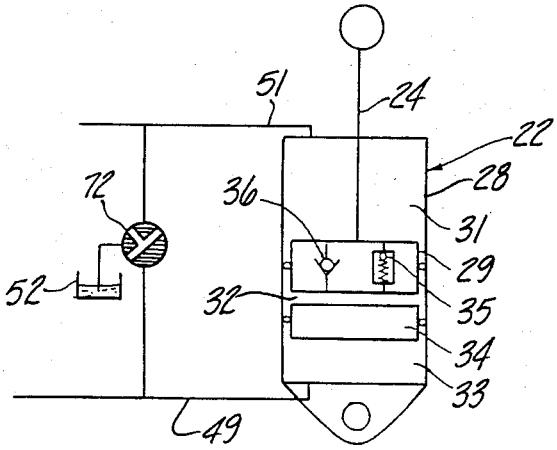
Fig-7
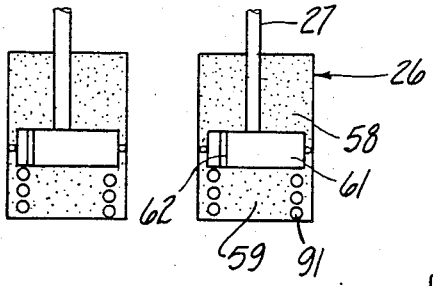
Fig-9
Fig-10
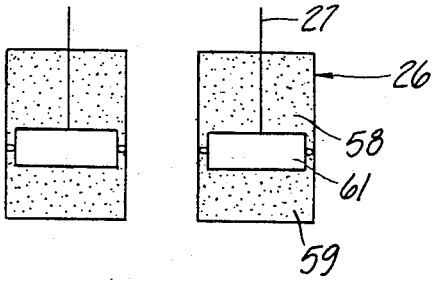

TILTING MECHANISM FOR MARINE PROPULSION DEVICE

BACKGROUND OF THE INVENTION

This invention relates to a tilting mechanism for a marine propulsion device and more particularly to an improved tilt and trim arrangement for an outboard drive.

It has been known to provide various arrangements for adjusting the trim angle of an outboard drive for a marine propulsion unit. The term "outboard drive" as used in the specification and claims hereof, is intended to refer to either the outboard drive portion of an inboard-outboard drive assembly or to an outboard motor per se. Adjustment of the trim angle of the outboard drive is desirable for a number of reasons. For example, when operating in shallow water, it is desired to provide a trim up condition for the outboard drive so as to minimize the likelihood of striking submerged obstacles. It has also been found that it is desirable to adjust the trim angle of the outboard drive in response to the actual speed of travel of the watercraft. The drag resistance of the lower unit is less in a trim down condition than in the trim up condition at certain low speeds. However, as the speed of the watercraft increases, there is a point at which the drag resistance is lowered if the unit is trimmed up.

It is, therefore, a principal object of this invention to provide an improved device for adjusting the trim of an outboard drive.

It is another object of this invention to provide an outboard drive trim adjusting device that is automatic in operation and which provides the minimum flow resistance under all running conditions.

It is another object of this invention to provide a trim adjusting device for a marine propulsion unit that automatically trims the drive up in response to predetermined conditions.

Although it is desirable to provide automatic trim adjustment for the outboard drive, the desirability of providing such automatic trim adjustment varies in response to running conditions. For example, when operating in reverse, it may not be desirable to have the outboard drive trim up automatically. This is true also under some other running conditions.

It is, therefore, a still further object of the invention to provide an automatic trim adjusting device for an outboard drive that is responsive to the specific running conditions.

With many types of outboard drives, it has been proposed to employ a hydraulic piston and cylinder arrangement for controlling both the trim and tilting of the outboard drive. Such arrangements are common with larger horsepower outboard motors and with most inboard-outboard drive arrangements. Normally, a relatively small diameter, fast operating tilt cylinder is employed for tilting the outboard drive from a submerged to a tilted up condition. Larger, slower acting trim cylinders also are employed that act against the outboard drive for adjusting the trim condition. Devices of the type heretofore employed have utilized a single hydraulic control circuit for both the trim and tilt cylinders. This has, therefore, necessitated trimming of the outboard drive through its full range before the motor can be tilted up. Of course, such an arrangement is rather time consuming in achieving the tilting up function.

It is, therefore, a still further object of this invention to provide an improved, simplified and faster acting tilt and trim cylinder arrangement.

SUMMARY OF THE INVENTION

A first feature of this invention is adapted to be embodied in a marine outboard drive comprising an outboard drive unit that is adapted to be supported relative to the full of an associated watercraft for pivotal movement about a horizontally extending trim axis between a trim down and a trim up position and means for automatically moving the outboard drive unit from its trim down to its trim up position when the velocity of the associated watercraft exceeds a predetermined amount.

Another feature of this invention is also adapted to be embodied in a marine outboard drive comprising an outboard drive unit that is adapted to be supported relative to the hull of an associated watercraft for movement about a horizontally extending trim axis between a trim down and a trim up position. In accordance with this feature of the invention, means are provided for automatically moving the outboard drive unit from its trim down position to its trim up position when the driving thrust of the associated watercraft falls below a predetermined value.

BRIEF DESCRIPTION OF THE DRAWINGS

FIG. 6 is a partial schematic view of the embodiment of FIG. 5 illustrating another condition.

FIG. 7 is a further, partial schematic view of the embodiment of FIGS. 5 and 6 showing a still further condition.

FIG. 9 is a cross-sectional view taken through the trim cylinders of a yet further embodiment of the invention.

FIG. 10 is a cross-section view taken through the trim cylinders of a yet another embodiment of the invention.

THEORY OF THE INVENTION

Figure 1:
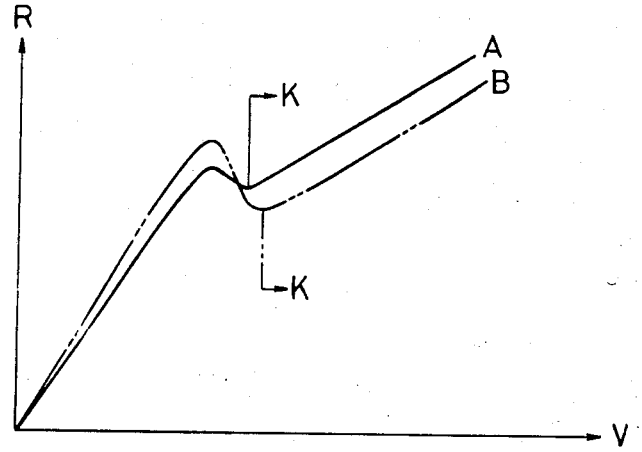
FIG. 1 is a graphical analysis explaining the principle of and reasons for the invention. In this analysis, the velocity of a watercraft is shown on the abscissa and the flow resistance of the outboard drive is shown on the ordinate.

FIG. 1 is a graphical analysis showing the flow resistance of an outboard drive unit in relation to speed of the associated watercraft. Two curves are shown, a solid line curve designated as "A" and a dot-dash curve designated as "B". The curve A represents the flow resistance provided by the outboard drive unit when in a trim down condition. The curve B represents the flow resistance of the same outboard drive unit in a trim up condition. It should be readily apparent that at the lower speeds, the flow resistance of the outboard drive is actually greater when the drive is trimmed up than when it is trimmed down. There is a point in each curve when the flow resistance decreases slightly with an increase in velocity, indicated by the point K for each curve, which occurs when the boat goes from an accelerating to an cruising or planing state. It is at approximately this point when the flow resistance of the outboard drive in the trim up condition falls below that of the outboard drive in the trim down condition. Therefore, it should be readily apparent that there is a speed at which it is desirable to move the outboard drive from a trimmed down to a trimmed up condition so as to reduce the flow resistance of the drive.

EMBODIMENT OF FIGS. 2 THROUGH 4

Figure 2:
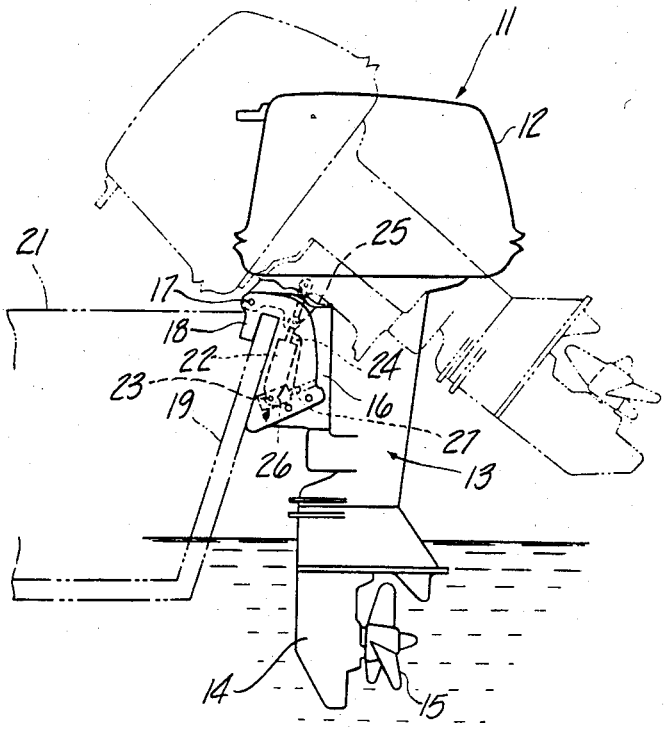
FIG. 2 is a side elevational view of a watercraft having an outboard motor constructed in accordance with this invention attached to its transom. The motor is shown in solid lines in the tilted down position and in phantom lines in the tilted up condition.
Figure 3:
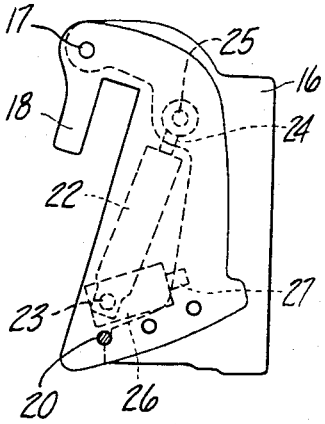
FIG. 3 is an enlarged, side elevational view showing the construction of the tilt and trim unit.
Figure 4:
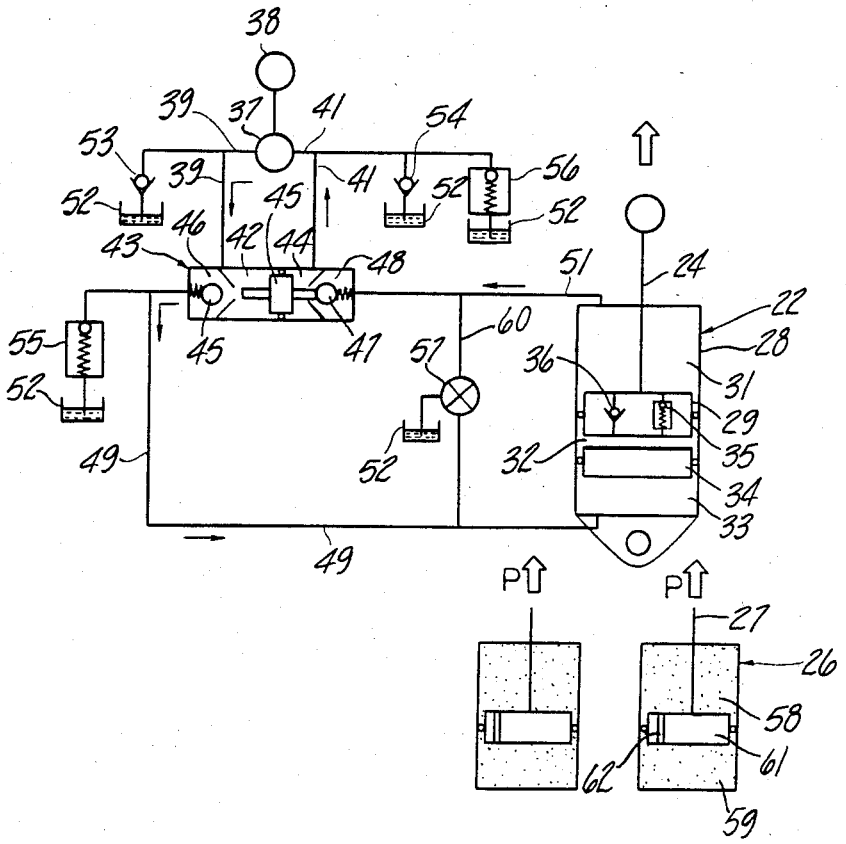
FIG. 4 is a partially schematic view showing the construction and operation of the tilt and trim unit of the embodiment of FIGS. 2 and 3.

FIGS. 2 through 4 show the application of a first embodiment of the invention to an outboard motor, indicated generally by the reference numeral 11. Although the invention is described in conjunction with an outboard motor, it is to be understood that it may be equally as well practiced with the outboard drive unit an inboard-outboard drive and, as has been previously noted, when the term outboard drive is used herein, it is intended to encompass both of such arrangements.

The outboard motor 11 includes a power head 12 that contains an internal combustion engine of any known type. Depending from the power head 12 is a drive shaft housing 13 in which a drive shaft (not shown) is contained and which is driven by the motor of the power head 12 in a known manner. A lower unit 14 depends from the drive shaft housing 13 and contains a forward, neutral, reverse transmission of a known type which, in turn, drives a propeller 15.

A steering shaft (not shown) is affixed to the drive shaft housing 13 and is journalled for steering movement about a generally vertically extending steering axis by a swivel bracket 16. The swivel bracket 16 is, in turn, supported for pivotal movement about a horizontally extending tilt axis by means of a pivot pin 17 which is, in turn, journalled in a clamping bracket 18 that is adapted to be affixed to a transom 19 of an associated watercraft 21 in a known manner. A leading edge of the swivel bracket 16 engages a trim pin 20 that is adjustably carried by the clamping bracket to set the trim down position of the motor 11.

A tilt cylinder assembly, indicated generally by the reference numeral 22, is provided for tilting the outboard motor 11 from a normal running condition in which the lower unit 14 and propeller 15 are submerged as shown in the solid line views in FIG. 2 to a tilted up out of the water condition, as shown in the phantom view in this figure. As will become more apparent, the tilt cylinder assembly 22 includes a cylinder housing that is connected, by means of a pivot pin 23, to the clamping bracket 18. In addition, the cylinder assembly 22 includes a piston rod 24 that is pivotally connected, by means of a pivot pin 25, to the swivel bracket 16. Accordingly, extension of the piston rod 24 relative to the cylinder housing will cause the motor 11 to be tilted up.

A trim cylinder assembly consisting of a pair of trim cylinders, each identified generally by the reference numeral 26, is also carried by the clamping bracket 18. The trim cylinder assemblies 26 are associated with piston rods 27 that are urged into engagement with the swivel bracket 16 for adjusting the trim position of the motor 11 in a manner to be described.

The construction and operation of the control for the tilt cylinder 22 and the operation of the trim cylinders 26 may be best understood by reference to the schematic view of FIG. 4. As seen in this figure, the tilt cylinder 22 includes a cylinder assembly 28 in which a piston 29 is supported for reciprocation. The piston 29 is connected to the piston rod 24 and divides the cylinder into an upper chamber 31 and a lower chamber, which in turn is divided into an upper part 32 and a lower part 33 by means of a floating piston 34. The chambers 32 and 33 are filled with a hydraulic fluid as is the associated hydraulic circuit, to be described, so that the pistons 34 and 29 may be hydraulically moved so as to tilt the motor 11 up and also so as to adjust its trim condition. In addition, the piston 29 operates to absorb underwater shocks applied to the motor 11 such as are encountered when a submerged obstacle is struck.

To provide this shock absorbing effect, a passage is formed through the piston 29 in which a pressure responsive absorber valve 35 is positioned. When a submerged obstacle is struck with sufficient force, the pressure generated in the chamber 31 will be sufficient to open the absorber valve 35 and permit the piston 29 and outboard motor 11 to pop up. When the underwater obstacle is cleared, reverse flow may occur from the chamber 32 to the chamber 31 through a return valve 36 that is adapted to open at a substantially lower pressure than the absorber valve 35 and specifically at a pressure that is equivalent to the pressure generated by the weight of the motor 11.

Tilting and trim operation is achieved by means of a reversible gear type hydraulic pump 37 that is driven by a reversible electric motor 38. The pump 37 has a first line 39 and a second line 41 communicating with its opposite sides. The line 39 communicates with a first chamber 42 of a shuttle valve assembly, indicated generally by the reference numeral 43. In a like manner, the line 41 communicates with a chamber 44 of the shuttle valve assembly 43. The chambers 42 and 44 are separated from each other by a shuttle piston 45.

A first pressure responsive check valve 45 controls the communication between the chamber 42 and a further chamber 46 of the shuttle valve assembly 43. In a like manner, a pressure responsive check valve 47 controls the communication of the chamber 44 with a still further chamber 48 of the shuttle valve assembly 43.

The chamber 46 communicates with a line 49 which, in turn, communicates with the tilt cylinder assembly 22 and specifically with the lower chamber part 33 at a point below the lowermost position of the floating piston 34. The shuttle valve chamber 48, in turn, communicates with a line 51 which, in turn, communicates with the tilt cylinder chamber 31 at a point above the uppermost position of the piston 29.

Fluid is supplied to the system from a sump 52. The sump 52 is adapted to supply fluid to the line 39 when the line 39 is a delivery line via a passage in which a check valve 53 is positioned. In a like manner, when the line 41 is functioning as the delivery line, fluid may be drawn from the sump 52 past a check valve 54.

A tilt up pressure relief valve 55 communicates the line 49 with the sump 52 so as to provide pressure relief on tilt up operation. In a similar manner, a tilt down relief valve 56 is provided to communicate the line 41 with the sump 52 when the tilt down pressure exceeds a predetermined value.

A manually controlled valve 57 is interposed in a conduit 60 that interconnects the lines 51 and 49 so as to provide for manual tilting up operation. The valve 57 also provides communication with the sump 52 during such manual operation so as to provide makeup fluid to compensate for the displacement of the piston rod 24.

The trim cylinders 26 are each divided into upper and lower chambers 58 and 59 by means of pistons 61. The piston rods 27 are affixed to the pistons 61. Unlike prior art arrangements, however, the trim cylinders 26 are not supplied with hydraulic fluid from the hydraulic system of the tilt cylinder 22. Rather, the chambers 58 and 59 are filled with a high pressure gas such as nitrogen. A passage 62 extends through the piston 61 so that the chambers 58 and 59 may freely communicate with each other. Thus, the high pressure gas in the chambers 58 and 59 will urge the pistons 61 constantly outwardly at a force indicated by the arrow P.

The force P is determined by the pressure of the gas in the chambers 58 and 59 and the area of the piston rod 27. This force P is chosen so that the combined forces of the tilt cylinders 26 (2P) will be slightly less than the weight of the motor and the force applied to the cylinders 26 by the forward driving thrust of the outboard motor until a predetermined speed is achieved or until the driving thrust falls below a predetermined value. When this speed is exceeded or the driving thrust falls below the predetermined value, the forces 2P will overcome the weight and driving thrust of the outboard motor 11 and cause it to move to a trim up condition, as will become apparent.

The embodiment of FIGS. 2 through 4 operates in the following manner. If it is desired to tilt the motor up, the electric motor 38 is energized so as to drive the pump 37 in a direction so that the line 39 is pressurized and the line 41 acts as the return and/or makeup line. Pressurization of the line 39 causes the shuttle valve chamber 42 to be pressurized while the shuttle valve chamber 44 will be exposed to return pressure. Hence, an unbalance pressure is exerted on the shuttle valve piston 45 that causes it to shift to the right as shown in FIG. 4 and have one of its two oppositely extending projections engage and open the ball check valve 47. At the same time, there will be sufficient pressure exerted by the pump 37 in the shuttle valve chamber 42 to overcome the spring bias of the check valve 45 and it also will open. The line 49 is then pressurized while the line 51 acts as a return line. Thus, pressure will be generated in the lower chamber part 33 beneath the floating piston 34. The piston 34 will be driven upwardly as will the piston 29 to cause the motor 11 to tilt up. The return fluid is delivered through the line 51 to the shuttle valve chamber 48 through the open check valve 47 to the chamber 44 and back to the inlet side of the pump 37 through the line 41.

When the motor 11 is tilting up, the gas pressure in the trim cylinders 26 will cause the piston 61 to follow the motor 11 unless the motor exceeds the length of the stroke of the piston 61 at which time they will bottom.

While the outboard motor 11 is operated in a trim down condition, the floating piston 34 and piston 29 are at the lower ends of their stroke and the pistons 61 are withdrawn. The swivel bracket will be engaged with the trimpin 20. Such a position is called a trim down condition.

Under this condition, if the motor 11 and specifically its lower unit 14 is travelling forwardly and strikes an underwater obstacle with sufficient force, the pressure in the chamber 31 will rise sufficiently to open the absorber valve 35 and permit the motor 11 to pop up. During this popping up action, there will be some movement of the floating piston 34 so as to compensate for the change in volume in the chamber 31 due to the difference in degree of immersion of the piston rod 24. Once the obstacle is cleared, the weight of the motor 11 will cause the return valve 36 to open and the motor 11 will return to its previously set trim position. During this popping up action, the trim piston 61 will also follow the movement of the motor due to their unbalanced gas pressure, however, they will again return to their normal trim position once the weight of the motor is applied on them. All of this assumes that the motor 11 is driving the watercraft at a low enough speed and with sufficient forward thrust so as to be maintained in its trim down condition.

When the motor 11 is operated in reverse, the action of the absorber valve 35 will tend to resist popping up of the motor.

During tilting up operation, if the motor 11 is tilted all of the way out of the water to the phantom line view shown in FIG. 1, when the piston 29 reaches the end of its stroke, there will be an abrupt rise in pressure in the line 49. The tilt up relief valve 55 will open under this condition so as to prevent damage to the hydraulic circuit. The motor 38 and pump 37 should be stopped at this time.

It should be readily apparent that tilting down operation is achieved in the reverse to the tilting up operation. That is, the motor 38 is energized so as to drive the pump 37 in a direction to pressure the line 41 and cause the line 39 to act as a return line. The shuttle piston 45 will then move to the left unseating the ball check valve 47 and permitting the line 49 and line 39 to act as the return line. The line 48 is pressurized due to unseating of the ball check valve 47 by the high pressure exerted in the chamber 44 and the upper side of the piston 29 is pressurized so as to force it downwardly. When the piston 29 and floating piston 34 reach the bottom limits of their stroke, the tilt down relief valve 56 will open and relieve the excess pressure back to the sump 52. Again, at this time, the operation of the motor 38 and pump 37 should be stopped.

The automatic trim up operation during acceleration will now be described. If it is desired to accelerate the watercraft 21 to a cruising, planing condition, the tilt cylinder 22 should be set in its lowermost condition. This effects full trim down of the motor 11 so as to provide the minimum flow resistance during initial acceleration. As the motor accelerates, the curve A in FIG. 1 will be followed. Under initial acceleration, the driving thrust, weight of the motor and pressure necessary to open the absorber valve 35 will be sufficient to overcome the force 2P exerted by the trim cylinders 26. However, as the watercraft 21 approaches the planing condition and begins to plane, the flow resistance will begin to decrease. At this speed, the driving thrust necessary to propel the boat will decrease and the force 2P will be sufficient to overcome this driving thrust and the pressure necessary to open the absorber valve 35 and the weight of the motor 11. Thus, the trim cylinders 26 will expand causing the piston 29 to move upwardly into the chamber 31 until the pistons 61 reach the full extent of their stroke. The motor 11 will then be in a trimmed up condition and the flow resistance of the lower unit will now follow the curve B in FIG. 1. Thus, it should be readily apparent that the construction offers the minimum flow resistance during the full range of acceleration to crusing condition. Of course, the movement from the trim down to the trim up condition does not occur abruptly but rather will occur gradually as the flow resistance decreases until the motor is fully trimmed up.

EMBODIMENT OF FIGS. 5 THROUGH 7

Figure 5:
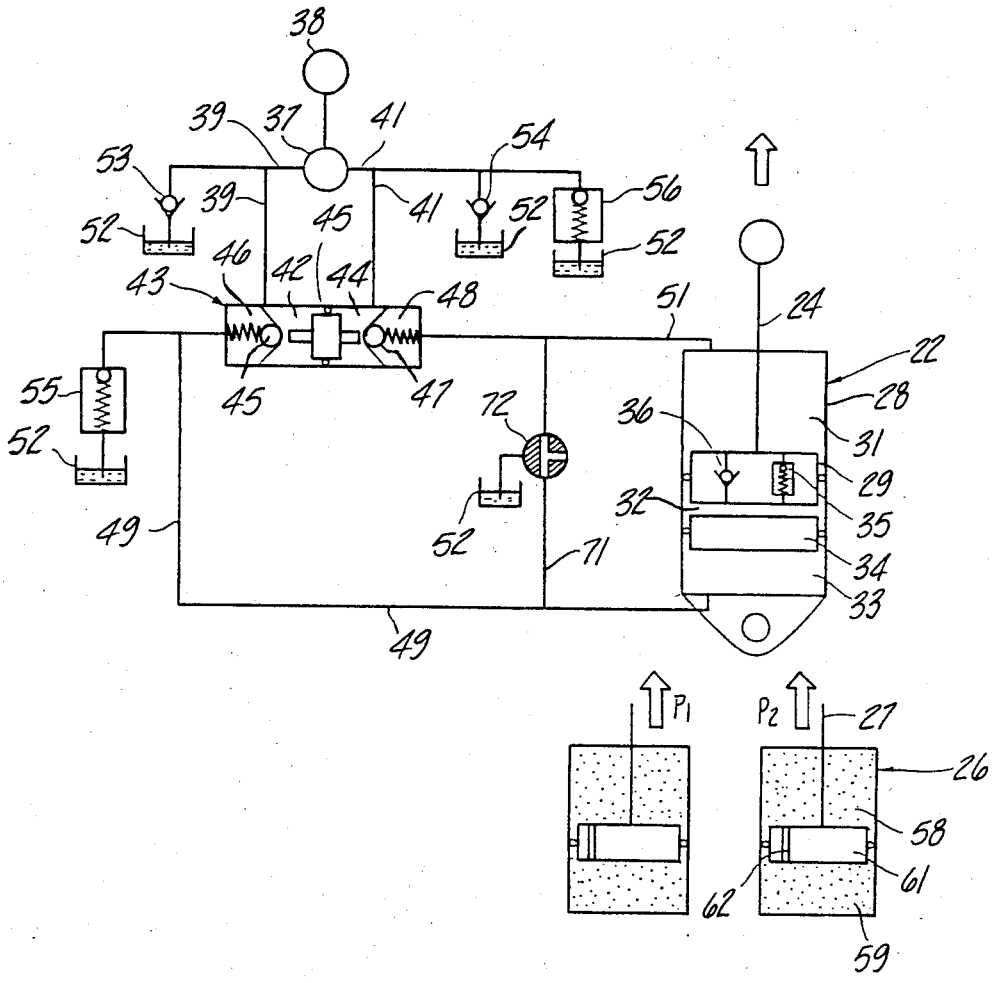
FIG. 5 is a schematic view, in part similar to FIG. 4, showing another embodiment of the invention.

In the embodiment of FIGS. 2 through 4, the valve 57 may be opened manually so as to permit manual tilting up of the outboard motor. In that embodiment, the pressure of the tilt cylinders must be sufficient to overcome not only the driving thrust of the motor and its weight, but also the force necessary to open the absorber valve 35. In the embodiments of FIGS. 5 through 7, a valving arrangement is provided that will eliminate the necessity for the trim cylinders to overcome the pressure necessary to open the absorber valve 35. In addition, this embodiment provides an interconnection between the valve and the shift mechanism so that popping up of the outboard motor when operating in reverse is resisted.

In this embodiment, the construction of the trim and tilt cylinders and the hydraulic system for providing tilting up and trim up operation is the same as the embodiment of FIGS. 2 through 4 and the same components have been identified by the same reference numerals. However, in this embodiment, a line 71 interconnects the lines 49 and 51 and has positioned in it a three-way valve 72. The three-way valve 72 is, as has been noted, connected to the shift mechanism of the outboard motor 11 so that it is positioned in the open condition as shown in FIG. 5 when the transmission of the motor 11 is in a forward position, and is moved to a fully closed position as shown in FIG. 7 when the transmission is operated in reverse. In addition, the valve 72 may be opened to a manual position as shown in FIG. 6 through a suitable manual actuation so as to communicate the lines 51 and 49 with each other and also with the sump 52 so as to facilitate manual tilting up and down of the outboard motor.

When the motor is operated in forward and the valve 72 is in the opened position as shown in FIG. 5, the motor will be held in a trim down condition during acceleration so long as the driving thrust is greater than the force 2P of the trim cylinders 26. However, when the boat goes into a planing condition and the driving thrust falls, the trim cylinders 26 can expand as previously described and cause the motor to move to its trim up condition. However, in this embodiment, this trim up operation does not necessitate opening of the absorber valve 35.

When operating in reverse, the valve 72 is suitably actuated to a fully closed position so that it is necessary to cause the absorber valve 35 to open before the motor can pop up. Hence, inadvertent popping up under reverse operation is precluded with this construction.

During manual tilting, the valve 72 is opened and also places the line 71 in communication with the sump 52 so that the motor may be manually tilted up easily and without necessitating the operator to overcome the force of the vacuum which would be generated due to the change in displacement of the piston rod 24 in the chamber 31 as the motor tilts up. In all other regards, this embodiment operates the same as the embodiment of FIGS. 2 through 4.

EMBODIMENT OF FIG. 8

Figure 8:
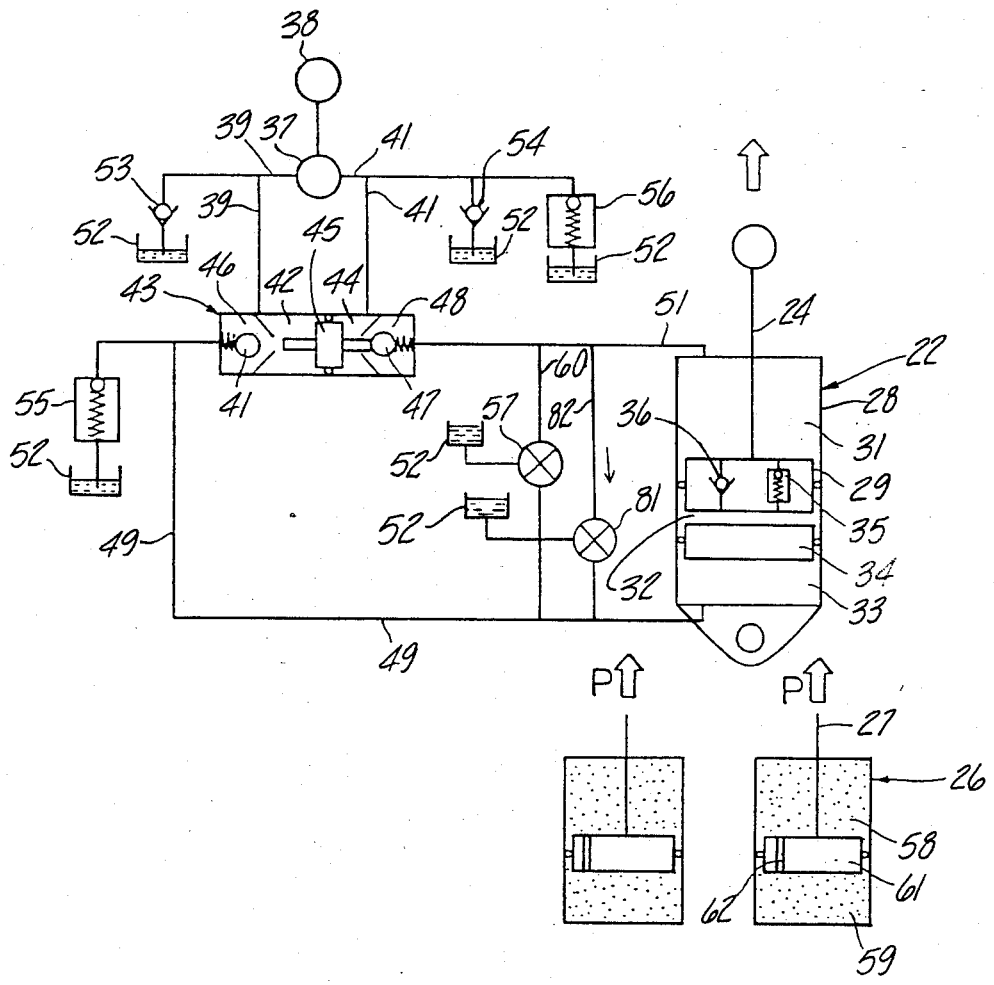
FIG. 8 is a schematic view, in part similar to FIGS. 4 and 5, showing a still further embodiment of the invention.

In the embodiment of FIGS. 5 through 7, it is necessary to provide an arrangement for controlling the valve 72 both in response to shifting of the transmission of the outboard and also in response to manual operation. Because of the necessity for providing both manual and automatic operation, the linkage or other system utilized to manipulate the valve 72 may be unduly complicated. The embodiment of FIG. 8 is similar to the embodiments of FIGS. 2 through 4 and the embodiments of FIGS. 5 through 7, however, it provides both the manually operated valve 57 of the embodiment of FIGS. 2 through 4 and an automatically operated valve 81 in a line 82 that parallels the line 58.

The manually operated valve 57 operates as the valve in the embodiments of FIGS. 2 through 4 and thus further description is not believed to be necessary. In addition, the hydraulic circuitry is the same as the previously described embodiments and thus has been identified by the same reference numerals and will not be described again.

The valve 81 in this embodiment is like the valve 72 of the embodiments of FIGS. 5 through 7. The valve is held in its opened position in response to shifting of the transmission of the outboard motor 11 into a forward condition. The valve 81 is moved to its closed position when the transmission is shifted into reverse. Thus, the automatic trim up operation of this embodiment will be the same as the embodiments of FIGS. 5 through 7 and does not necessitate of the absorber valve 35.

EMBODIMENT OF FIG. 9

In the embodiments thus far described, the gas pressure in the trim cylinders 26 provides the total force for urging the motor to its trimmed up condition. It is possible to also provide a spring 91 in the chambers 59 of each of the trim cylinders 26 to assist the gas pressure. Alternatively, if a greater force is required, it may be achieved by employing a larger diameter piston rod 27 so as to provide a larger effective area.

EMBODIMENT OF FIG. 10

In all of the embodiments previously described, the trim pistons are provided with a through passage 62 that provides communication between their upper and lower chambers 58 and 59. Of course, it would be possible to provide this communication through an external passage. Alternatively, it may be possible to provide no passage whatsoever through the piston as shown in FIG. 10.

It should be readily apparent that a number of embodiments of the invention have been illustrated and described, each of which assures trimming of an outboard drive in a condition that provides the least flow resistance under all running conditions. That is, in each embodiment, the outboard drive is automatically trimmed up once the boat reaches a planing condition. In each embodiment, the trimming up is achieved at a predetermined decrease in driving thrust or at a predetermined velocity of the boat or both. Although a number of embodiments of the invention have been illustrated and described, various other changes and modifications may be made without departing from the spirit and scope of the invention, as defined by the appended claims.

I claim:

1. A marine outboard drive comprising an outboard drive unit adapted to be supported relative to the hull of an associated watercraft for pivotal movement about a horizontal extending trim axis between a trim down and a trim up position and velocity responsive means for automatically moving said outboard drive unit from its trim down position to its trim up position when the velocity of the associated watercraft exceeds a predetermined value, said velocity responsive means comprising means for exerting a predetermined and constant force on said outboard drive for tilting up said outboard drive when the driving thrust and weight of said outboard drive fall below a predetermined value.

2. A marine outboard drive as set forth in claim 1 further including a tilt cylinder assembly interposed between the drive unit and the hull for effecting tilting up of the outboard drive unit from either of its trim positions to a tilted up out of the water position.

3. A marine outboard drive as set forth in claim 1 further including means for adjusting the trim of the outboard drive unit between the trim down position and the trim up position, the means for automatically moving the outboard drive unit being effective to move the outboard drive unit from any of its trim adjusted positions to its trim up position.

4. A marine outboard drive as set forth in claim 3 wherein the means for adjusting the trim position of the outboard drive comprises a first hydraulic cylinder and the means for automatically moving the outboard drive comprises a pneumatic cylinder.

5. A marine outboard drive as set forth in claim 4 wherein the hydraulic cylinder is operative to move the outboard drive unit from its trim down position to a tilted up out of the water position.

6. A marine outboard drive as set forth in claim 5 wherein the pneumatic cylinder is operative to exert the predetermined and constant force on the outboard drive for tilting up the outboard drive when the driving thrust and weight of the outboard drive fall below a predetermined value.

7. A marine outboard drive as set forth in claim 6 wherein the hydraulic cylinder is operative to provide popping up shock absorbing action when the outboard drive strikes an underwater obstacle.

8. A marine outboard drive as set forth in claim 7 wherein the hydraulic cylinder further includes a floating piston.

9. A marine outboard drive as set forth in claim 8 further including passage extending between opposite sides of the hydraulic cylinder and manually operated valve means in said passage means for providing free communication between opposite sides of said hydraulic cylinder for manual tilting up operation.

10. A marine outboard drive as set forth in claim 8 further including passage means extending between opposite sides of the hydraulic cylinder for providing communication between the opposite sides, valve means in said passage means and means for operatively controlling the valve means in response to the condition of the transmission of the outboard drive unit.

11. A marine outboard drive as set forth in claim 10 further including manually operated valve means for permitting free communication between opposite sides of the hydraulic cylinder for manual tilting up.

12. A marine outboard drive comprising an outboard drive unit adapted to be supported relative to the hull of an associated watercraft for pivotal movement about a horizontally extending trim axis between a trim down position and a trim up position and driving thrust responsive means for automatically moving said outboard drive from its trim down position to its trim up position when the driving thrust of the outboard drive falls below a predetermined value.

13. A marine outboard drive as set forth in claim 12 further including a tilt cylinder assembly interposed between the drive unit and the hull for effecting tilting up of the outboard drive unit from either of its trim positions to a tilted up out of the water position.

14. A marine outboard drive as set forth in claim 12 further including means for adjusting the trim of the outboard drive unit between the trim down position and the trim up position, the means for automatically moving the outboard drive unit being effective to move the outboard drive unit from any of its trim adjusted positions to its trim up position.

15. A marine outboard drive as set forth in claim 14 wherein the means for adjusting the trim position of the outboard drive comprises a first hydraulic cylinder and the means for automatically moving the outboard drive comprises a pneumatic cylinder.

16. A marine outboard drive as set forth in claim 15 wherein the hydraulic cylinder is operative to move the outboard drive unit from its trim down position to a tilted up out of the water position.

17. A marine outboard drive as set forth in claim 16 wherein the pneumatic cylinder is operative to exert a predetermined and constant force on the outboard drive for tilting up the outboard drive when the driving thrust and weight of the outboard drive fall below a predetermined value.

18. A marine outboard drive as set forth in claim 17 wherein the hydraulic cylinder is operative to provide popping up shock absorbing action when the outboard drive strikes an underwater obstacle.

19. A marine outboard drive as set forth in claim 18 wherein the hydraulic cylinder further includes a floating piston.

20. A marine outboard drive as set forth in claim 19 further including passage means extending between opposite sides of the hydraulic cylinder and manually operated valve means in said passage means for providing free communication between opposite sides of said hydraulic cylinder for manual tilting up operation.

21. A marine outboard drive as set forth in claim 19 further including passage means extending between opposite sides of the hydraulic cylinder for providing communication between the opposite sides, valve means in said passage means and means for operatively controlling the valve means in response to the condition of the transmission of the outboard drive unit.

22. A marine outboard drive as set forth in claim 21 further including manually operated valve means for permitting free communication between opposite sides of the hydraulic cylinder for manual tilting up.

* * * * *